US007141144B2

(12) United States Patent
Rydin

(10) Patent No.: US 7,141,144 B2
(45) Date of Patent: Nov. 28, 2006

(54) MULTI-LAYER WOVEN SEAM BASEWEAVE HAVING DIFFERENT SIZED SEAM ATTACHMENTS

(75) Inventor: Björn Rydin, Hörby (SE)

(73) Assignee: Albany International Corp., Albany, NY (US)

( * ) Notice: Subject to any disclaimer, the term of this patent is extended or adjusted under 35 U.S.C. 154(b) by 536 days.

(21) Appl. No.: 10/309,636

(22) Filed: Dec. 4, 2002

(65) Prior Publication Data

US 2004/0109960 A1 Jun. 10, 2004

(51) Int. Cl.

| | |
|---|---|
| ***D21F 7/10*** | (2006.01) |
| ***D21F 7/08*** | (2006.01) |
| *D21F 7/12* | (2006.01) |
| *D03D 3/04* | (2006.01) |

(52) U.S. Cl. ..... 162/358.2; 162/900; 162/904; 428/33; 428/58

(58) Field of Classification Search ..... 162/116, 162/117, 199, 348, 358.1, 358.2, 900, 902, 162/903, 904, 362; 428/33, 57, 58; 442/268, 442/270, 239–241, 246, 247; 8/110, 142; 139/383 AA, 383 A, 425 A; 24/31 R; 28/110, 28/142

See application file for complete search history.

(56) References Cited

U.S. PATENT DOCUMENTS 4,418,726 A * 12/1983 Josef et al. ..... 139/383 AA
4,427,734 A 1/1984 Johnson
4,539,730 A * 9/1985 Romanski ..... 24/33 B
4,865,083 A 9/1989 Cunnane
4,887,648 A 12/1989 Cunnane
4,896,702 A * 1/1990 Crook ..... 139/383 A
5,049,029 A 9/1991 Roman
5,217,415 A 6/1993 Wasylezuck et al.
5,360,656 A 11/1994 Rexfelt et al.
5,915,422 A 6/1999 Fagerholm
6,194,331 B1 * 2/2001 Elkins ..... 442/225
6,302,155 B1 10/2001 Rydin
6,328,079 B1 12/2001 Zils

FOREIGN PATENT DOCUMENTS

| | | |
|---|---|---|
| DE | 1 251 105 | 9/1967 |
| EP | 0 251 873 B1 | 6/1987 |
| GB | 1 598 698 * | 9/1981 |
| JP | 1239188 A2 | 3/1988 |
| WO | WO 99/19564 | 4/1999 |

* cited by examiner

*Primary Examiner*—Eric Hug
(74) *Attorney, Agent, or Firm*—Frommer Lawrence & Haug: LLP; Ronald R. Santucci

(57) ABSTRACT

A multi-layer woven papermaker's fabric having at least two sets of seam loops. Longer and a shorter seam attachment mechanisms are used to connect the bottom and top layer seam loops. The longer attachment mechanism in the top layer being over the shorter attachment mechanism in the bottom layer, and vice versa. A pintle or installation cable is positioned between each set of connectors to form a seam. The pair of connectors for each set of seam loops comprises different lengths in the MD direction such that the pintle or installation cables on adjacent layers are offset in the MD direction.

26 Claims, 3 Drawing Sheets

MULTI-LAYER WOVEN SEAM BASEWEAVE HAVING DIFFERENT SIZED SEAM ATTACHMENTS

BACKGROUND OF THE INVENTION

1. Field of the Invention

The present invention relates primarily to the papermaking arts. Specifically, the present invention relates to seaming multi-layer integrally woven fabrics for use on papermaking machines.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The present invention relates primarily to the fabrics used in the press section, generally known as press fabrics, but it may also find application in the fabrics used in the forming and dryer sections, as well as in those used as bases for polymer-coated paper industry process belts, such as, for example, long nip press belts, industrial fabrics and/or engineered fabrics such as pulp forming fabrics, sludge dewatering fabrics and Double Nip Thickener (DNT) dewatering fabrics, among others.

Press fabrics play a critical role during the paper manufacturing process. One of their functions, as implied above, is to support and to carry the paper product being manufactured through the press nip.

Press fabrics also participate in the finishing of the surface of the paper sheet. That is, press fabrics are designed to have smooth surfaces and uniformly resilient structures, so that, in the course of passing through the press nips, a smooth, mark-free surface is imparted to the paper.

Perhaps most importantly, the press fabrics accept the large quantities of water extracted from the wet paper in the press nip. In order to fulfill this function, there literally must be space, commonly referred to as void volume, within the press fabric for the water to go, and the fabric must have adequate permeability to water for its entire useful life. Finally, press fabrics must be able to prevent the water accepted from the wet paper from returning to and rewetting the paper upon exit from the press nip.

Contemporary press fabrics are used in a wide variety of styles designed to meet the requirements of the paper machines on which they are installed for the paper grades being manufactured. Generally, they comprise a woven base fabric into which has been needled a batt of fine, non-woven fibrous material. The base fabrics may be woven from monofilament, plied monofilament, multifilament or plied multifilament yarns, and may be single-layered, multi-layered or laminated. The yarns are typically extruded from any one of several synthetic polymeric resins, such as polyamide and polyester resins, used for this purpose by those of ordinary skill in the paper machine clothing arts.

The woven base fabrics themselves take many different forms. For example, they may be woven endless, or flat woven and subsequently rendered into endless form with a woven seam. Alternatively, they may be produced by a process commonly known as modified endless weaving, wherein the widthwise edges of the base fabric are provided with seaming loops using the machine-direction (MD) yarns thereof. In this process, the MD yarns weave continuously back-and-forth between the widthwise edges of the fabric, at each edge turning back and forming a seaming loop. A base fabric, produced in this fashion is placed into endless form during installation on a paper machine, and for this reason is referred to as an on-machine-seamable fabric. To place such a fabric into endless form, the two widthwise edges are brought together, the seaming loops at the two edges are interdigitated with one another, and a seaming pin or pintle is directed through the passage formed by the interdigitated seaming loops.

Further, the woven base fabrics may be laminated by placing one base fabric within the endless loop formed by another and by needling a staple fiber batt through both base fabrics to join them to one another. One or both woven base fabrics may be of the on-machine-seamable type.

In any event, the woven base fabrics are in the form of endless loops, or are seamable into such forms, having a specific length, measured longitudinally therearound, and a specific width, measured transversely thereacross. Because paper machine configurations vary widely, paper machine clothing manufacturers are required to produce fabrics, and belts, to the dimensions required to fit particular positions in the paper machines of their customers. Needless to say, this requirement makes it difficult to streamline the manufacturing process, as each fabric must typically be made to order.

In response to this need to produce fabrics in a variety of lengths and widths more quickly and efficiently, press fabrics have been produced in recent years using a spiral technique disclosed in commonly assigned U.S. Pat. No. 5,360,656 to Rexfelt et al., the disclosure of which is incorporated herein by reference.

U.S. Pat. No. 5,360,656 shows a press fabric comprising a base fabric having one or more layers of staple fiber material needled thereinto. The base fabric comprises at least one layer composed of a spirally wound strip of woven fabric having a width which is smaller than the width of the base fabric. The base fabric is endless in the longitudinal, or machine, direction. Lengthwise threads of the spirally wound strip make an angle with the longitudinal direction of the press fabric. The strip of woven fabric may be flat-woven on a loom which is narrower than those typically used in the production of paper machine clothing.

The base fabric comprises a plurality of spirally wound and joined turns of the relatively narrow woven fabric strip. The fabric strip is woven from lengthwise (warp) and crosswise (filling) yarns. Adjacent turns of the spirally wound fabric strip may be abutted against one another, and the helically continuous seam so produced may be closed by sewing, stitching, melting or welding. Alternatively, adjacent longitudinal end portions of adjoining spiral turns may be arranged overlappingly, so long as the ends have a reduced thickness, so as not to give rise to an increased thickness in the area of the overlap. Further, the spacing between lengthwise yarns may be increased at the ends of the strip, so that, when adjoining spiral turns are arranged overlappingly, there may be an unchanged spacing between lengthwise threads in the area of the overlap.

In the case of dryer fabrics, in particular, such fabrics were produced by flat weaving and then joined together. Dryer fabrics that are used today are long and require a seam for installation, since dryer section frames are solid without cantilever components and thus prevent the use of endless woven fabrics. Accordingly, the fabrics must be installed with a seam, since they cannot be put on endless.

It should be noted that contemporary fabrics also include fabrics with non-woven bases. An example of a non-woven fabric is shown in U.S. Pat. No. 4,427,734, which discloses a wet press felt for use on papermaking machines. The wet press felt includes a conventional felt fabric and a multiple of non-woven layers of synthetic textile fibers needled to the felt. Interposed between the layers of synthetic textile fiber are mesh fabrics which support the individual non-woven layers and retard compaction of the overall construction. Such non-woven fabrics may be provided with seams like those of the woven fabrics in order to realize an "endless" non-woven fabric.

In addition to the aforenoted modified endless weaving which provides a seamable fabric, there exists other types of seams heretofore utilized, particularly in the case of dryer fabrics. For example, some flat woven dryer fabrics had clipper hook seams as are used in corrugator belts today. However, clipper hooks tend to corrode. More importantly, clipper hooks wear, do not flex well (they tend to bump around fabric support rolls), and the seam tends to mark the paper sheet.

Some fabrics and belts are seamed on a diagonal in a manner as set forth in U.S. Pat. No. 5,217,415 which has been found satisfactory for certain applications.

Seams can also be sewn on which involves a webbing sewn onto both cross-machine direction ("CD") ends of the dryer fabric. The webbing contains loops which are meshed together to form the seam. The webbing, since it is out of plane and thicker than the fabric body, also tends to bump around fabric support rolls, marks the sheet, and has zero permeability, which further exacerbates the sheet marking problem. Since it is sewn on, the stitching is between the web and the fabric body. Once the stitching fails, the web will pull off, resulting in a "seam failure".

The market today is dominated by fabrics having pin seams, with or without a spiral insert. These seams require MD yarns to be woven back into the structure body by hand or machine assisted. CD yarns must be raveled out. Yarn materials, counts and sizes, weaves dictate the seam properties and the seam properties (uniformity, strength) dictate yarn counts within a certain weave. These seams are expensive to make, since they are labor intensive. The strength and seam durability are dictated by material properties too, especially loop strength. "Brittle" materials which have poor loop strength but may have other good properties are not dryer fabric candidates because of this. To compensate for low seam loop strength one may have to compromise on the fabric structure itself. An example of a seam having a spiral insert can be found in U.S. Pat. No. 5,915,422.

Early metal forming fabrics which were flat woven and shipped open ended, were installed on the machine with the metal wire ends joined together by brazing or fusing the yarns by heat. This "butt seam" had some slight end overlap and the seam only lasted for a short period of time. There was no sewing, stitching, or adding in a synthetic spiral.

Another example of a butt seam can be found in the aforementioned U.S. Pat. No. 5,360,656. This seam is between adjacent strips of fabric and includes stitching. The seams, however, are not load bearing and are merely there to hold the strips together so that the "base" structures formed by these joined together strips can be handled through the manufacturing process.

U.S. Pat. Nos. 4,887,648 and 4,865,083 disclose various embodiments of pin seams in a four layer integrally woven fabric, both with and without spiral inserts. These patents disclose the use of loops formed from the MD yarns on each side of the dryer fabric. Thus, as noted above, the formation of these loops is a time intensive procedure. In order to avoid such a procedure, a spiral insert may be employed, such as that shown in FIG. 11 of these patents. Rather than meshing the loops from each edge together, a spiral insert meshes with the MD yarn formed loops. Thereafter, two pintles are inserted, one fixing each end of the dryer layer to the spiral insert to form the appropriate desired seam.

Obviously, there are other ways to provide seamable fabrics for use in papermaking and other industrial applications, with the foregoing being set forth merely as examples. However, as with anything, there is always a desire to improve on or provide an alternative to what has been done previously. Seamable fabrics are no exception. In this regard, heretofore providing a seam on a fabric has been relatively time consuming and labor intensive. If these are aspects that can be improved upon, this would obviously be a desirable result.

The present invention provides yet another approach toward forming the spirally continuous seam in a fabric of this type.

SUMMARY OF THE INVENTION

Accordingly, the present invention is both a method for manufacturing a papermaker's fabric, and the fabric made in accordance with the method.

A fabric in accordance with the invention is formed of a woven fabric, that is in the form of a multi-layer weave. The multi-layer weave is preferably at least a four layer weave. That is two MD yarns form one set of seam loops and the other two MD yarns form a second set of seam loops. Each edge of the multi-layer weave has two sets of seam loops. These loops are preferably formed by a modified endless weave process. Normally, these two sets of seam loops are aligned one on top of the other and are woven together and a pintle inserted, forming two seams like in U.S. Pat. No. 4,865,083. Experience has found that such a fabric is difficult to seam together on the papermachine. Furthermore, the seam(s) are a discontinuity. That is, they are different from the main body of the fabric. This difference can cause unwanted operational problems such as seam marking in the paper sheet produced.

When producing a laminated structure with two seams like in Elkins, U.S. Pat. No. 6,194,331, offsetting the seam has great advantages. This is difficult to do in any integrally woven fabric. The only way to accomplish this by weaving is to make one set of loops (top or bottom) on one edge, longer than the other set in the MD. This would mesh with the loops (longer or shorter) on the other edge. Of course, the long loops on one edge would mesh with the short length loops on the other edge.

An alternative method is that proposed here. The fabric is woven with the two sets of loops of the same length in the conventional endless manner, so that both seams align. To the top (or bottom) sets of loops, two seam attachments are connected, for example, two spirals. A longer and a shorter spiral connector are attached to the bottom (and top) loops. The longer spiral connector in the top being over the shorter spiral connector in the bottom and vice versa. Each spiral connector is attached to a respective MD yarn of each end of the fabric. A pintle or installation cable is positioned between the two spiral connectors to form a seam between them. The pair of spiral connectors for each set of seam loops employed in the multi-layer weave comprises different lengths in the MD direction so that the pintle or installation cables on adjacent layers are offset from each other in the MD direction so no bump or raised portion at the seam is formed.

This configuration distributes the difference in the seam area versus the body over a longer distance. Stuffer yarns or other materials as taught in Elkins, (the '331 patent) can be inserted to further minimize this difference.

It is therefore a principal object of the invention to provide for a seamable papermaker's or industrial fabric wherein the seam is readily incorporated into a multiple layer fabric.

It is a further object of the present invention to provide for such a fabric which allows the seams to be implemented in a cost-effective manner.

A yet further object of the present invention is to provide for such a seam which may be utilized on a variety of fabrics with different constructions, such as those where the MD yarns are not single monofilaments, but plied monofilaments which are difficult to mesh together.

These and other objects and advantages are provided by the present invention. In this regard, the invention is directed towards providing a seam on a fabric, particularly a papermaker's or industrial fabric, which may be relatively easy to implement for use with a plurality of multi-layer weaves. It involves the use of preformed loops or spirals which are respectively attached to each end of the fabric of the multi-layer weave to be joined in the cross-machine direction. As shown in FIG. 3, the spirals are preferably connected to MD loops of the fabric by a CD "pin." This pin can be a single yarn of monofilament or metal. It can be round or take on a shape such as oval, rectangular, etc. It can also be composed of several yarns twisted and held together such as taught in U.S. Pat. No. 5,049,025 which is incorporated herein by reference. The pins connecting each set of seam attachment mechanisms can be the same or different. The spirals may also be sewn onto the end using a yarn or thread, which is sewn or looped around all or some of the respective bases of the loops of the spiral and then sewn back onto the body of the fabric. (See co-pending U.S. patent application Ser. No. 10/159,926 entitled "Papermaker's and Industrial Fabric Seam", the disclosure of which is incorporated herein by reference.) Each spiral base is preferably affixed with at least one, or preferably more, yarns or threads. Each pair of spirals for each set of loops in the multi-layer weave have different lengths in the MD direction so that inserted pintles or installation cables for each of the multi-layer weaves do not align with each other.

The stitching pattern for attaching the spiral spirals can be zig-zag, chain, or lock pattern and may involve stitching lengths that vary to the extent in which they extend into the base fabric. Also, the angle of the stitch may vary along with the number of stitches attaching the base of the loops of each spiral. The stitching may be further reinforced by stitching along the end of the fabric in the cross-machine direction and may comprise several rows thereof. The ends of the base fabric may also be further pre- and/or post-treated by compaction, pre-squeezing and sealing to stabilize the ends. Ultrasonic melting or fusing, pressing with or without heat, and chemical bonding such as adding a glue or resin may also be used. Note, however, that it is important to keep the seam area at least near to the air permeability of the fabric body. Also, such pre- and/or post-treatment can be used, not only to stabilize the ends, but also to reinforce and provide a smooth surface in the stitched area.

It has been found that such an arrangement reduces substantially the amount of time necessary to attach a seam to a fabric whilst providing for an effective seam, when used with a plurality of multi-layer weaves. Other methods of attaching the spirals to the ends may also be utilized.

The present invention will now be described in more complete detail with frequent reference being made to the figures identified as follows. It should be noted that all of the above noted U.S. Patents are incorporated hereinto by reference in their entirety.

DETAILED DESCRIPTION OF THE PREFERRED EMBODIMENT

Figure 1:
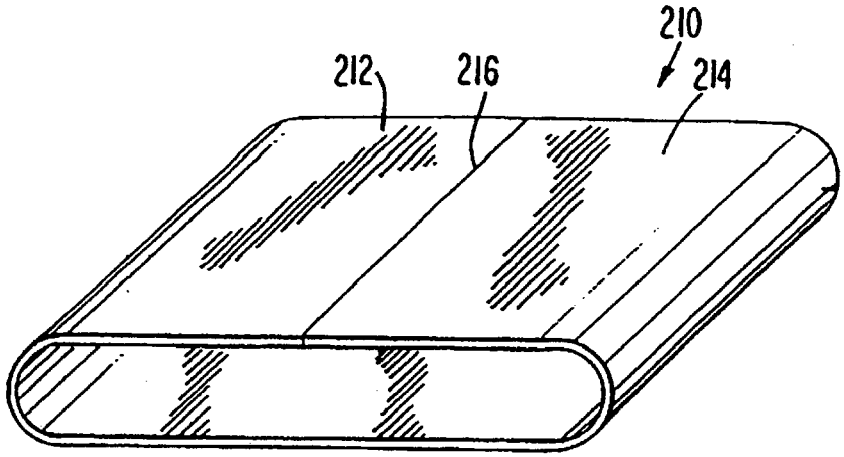
FIG. 1 is a schematic perspective view of a seamed fabric.

Referring now to the several figures, FIG. 1 is a schematic perspective view of a first embodiment of a seamed papermaker's or industrial fabric 210. The fabric 210 takes the form of an endless loop once its two ends 212, 214 have been joined to one another at seam 216.

Figure 2:
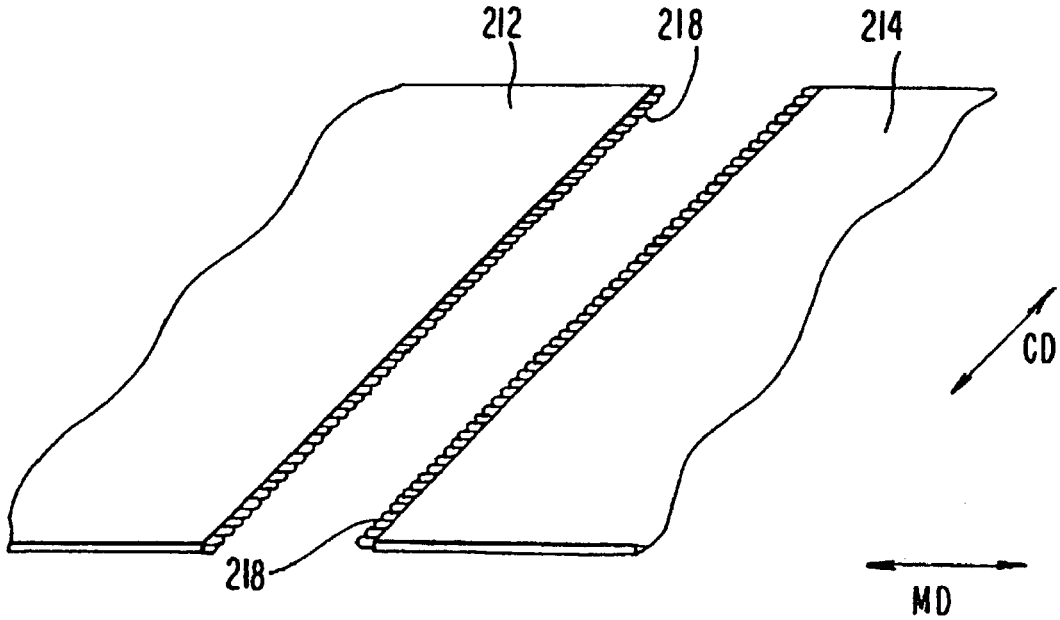
FIG. 2 is a schematic topside perspective view of the two ends of the fabric prior to their being joined to one another.

FIG. 2 is a schematic perspective view of the two ends 212, 214 of the top set of seam loops of the fabric 210 prior to their attachment to one another. Widthwise across the ends of each of two ends 212, 214 are a plurality of loops 218. To attach the two ends 212, 214 to one another, they are brought together, in so doing alternating and intermeshing, or interdigitating, the seaming loops 218 at each end with one another. The interdigitated seaming loops 218 define a passage through which a pin, or pintle, a yarn-like strand or member, or an installation cable may be directed to secure the ends 212, 214 to one another by way of the "pin seam" so formed.

In the present invention, the seaming loops 218 are instead attached to preformed loops or spirals 220 which are attached to the ends 212, 214 of the fabric as will be discussed. Note while loops or spirals are being referred to other types of seaming or coupling elements suitable for the purpose such as that disclosed in U.S. Pat. No. 6,328,079 B1 may be utilized.

Figure 3:
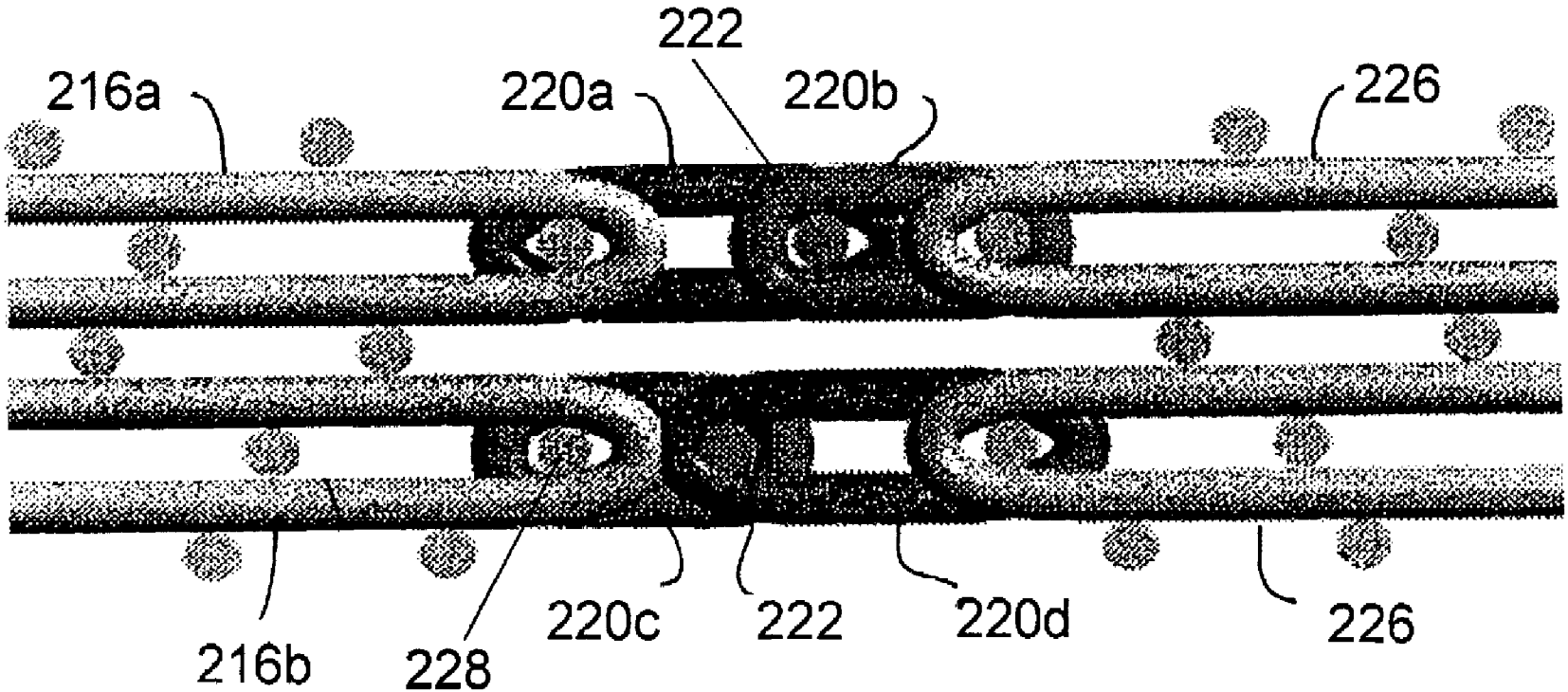
FIG. 3 is a cross-section view of a fabric seamed according to the present invention.

Referring next to FIG. 3, a preferred embodiment constructed in accordance with the present invention is shown. As is shown in FIG. 3, a four layer integrally woven fabric has two sets of seam loops on each edge as shown. The weave is such that a seam joining a first end thereof to a second end thereof for each of the double-layer weaves is positioned in a complementary position. As is noted above with respect to FIGS. 2 and 4, a spiral 220 is attached to each end of each layer (216*a*, 216*b*) of the multi-layer weave. Thus, as is shown in FIG. 3, spirals 220*a* and 220*b* are attached to respective top loops of multi-layer weave 216*a*, while spirals 220*c* and 220*d* are fixed to corresponding loops of multi-layer weave 216*b*. These spirals are placed substantially concentric and extend in the same direction along machine direction yarns 226, and are attached to the multi-layer weave through engagement with cross-machine direction pintle 228. As is again noted with respect to FIG. 4, upon joining the corresponding spiral 220 (220*a*, 220*b*, 220*c* and 220*d*) fits to corresponding ends of a similar multi-layer weave, a pin, pintle or installation cable is inserted therebetween in order to hingedly fix the spirals to each other.

In accordance with the embodiment of the invention as set forth in FIG. 3, it is desirable that pintle 222 (joining spirals 220*a* and 220*b* of the upper layer) be offset in its position from pintle 222 (joining spirals 220*c* and 220*d* of the lower layer weave 216*b*). Therefore, in accordance with the invention, the length of spiral 220*a* in the machine direction is different than the length of spiral 220*c* in the machine direction. Similarly, the length of spiral 220*b* in the machine direction is different from the length of spiral 220*d* in the machine direction. In this manner, pintles 222 are not aligned to each other upon insertion.

Preferably, the effective length of the combination of spirals 220*a* and 220*b* is substantially equal to the effective length of spirals 220*c* and 220*d*.

Furthermore, while the invention with respect to FIG. 3 has been described for a four layer weave, any number of other multi-layer weaves may be provided. In such a situation, a next pintle 222 may be lined up in a third position so as not to overlap with either of the other two pintles, or alternatively, the third pintle 222 may be positioned similarly to that of pintle 222 joining spirals 220*a* and 220*b* but with spirals 220*c* and 220*d* placed between the layer 216*a* and the new layer. Therefore, while the new pintle 222 would be in registration with pintle 222 joining spirals 220*a* and 220*b*, the spirals corresponding to layer 216*b* would not be in registration and therefore the alignment would not effect the overall shape of the surface.

In this manner, it is possible to provide a number of multi-layer weaves adjacent each other without generating a significant difference in the fabric at a seam thereof. While this construction is preferably employed in accordance with a seam such as that shown in FIG. 1, it may equally be employed with any type of seam employed in a fabric of the type described with reference to this application.

Figure 4:
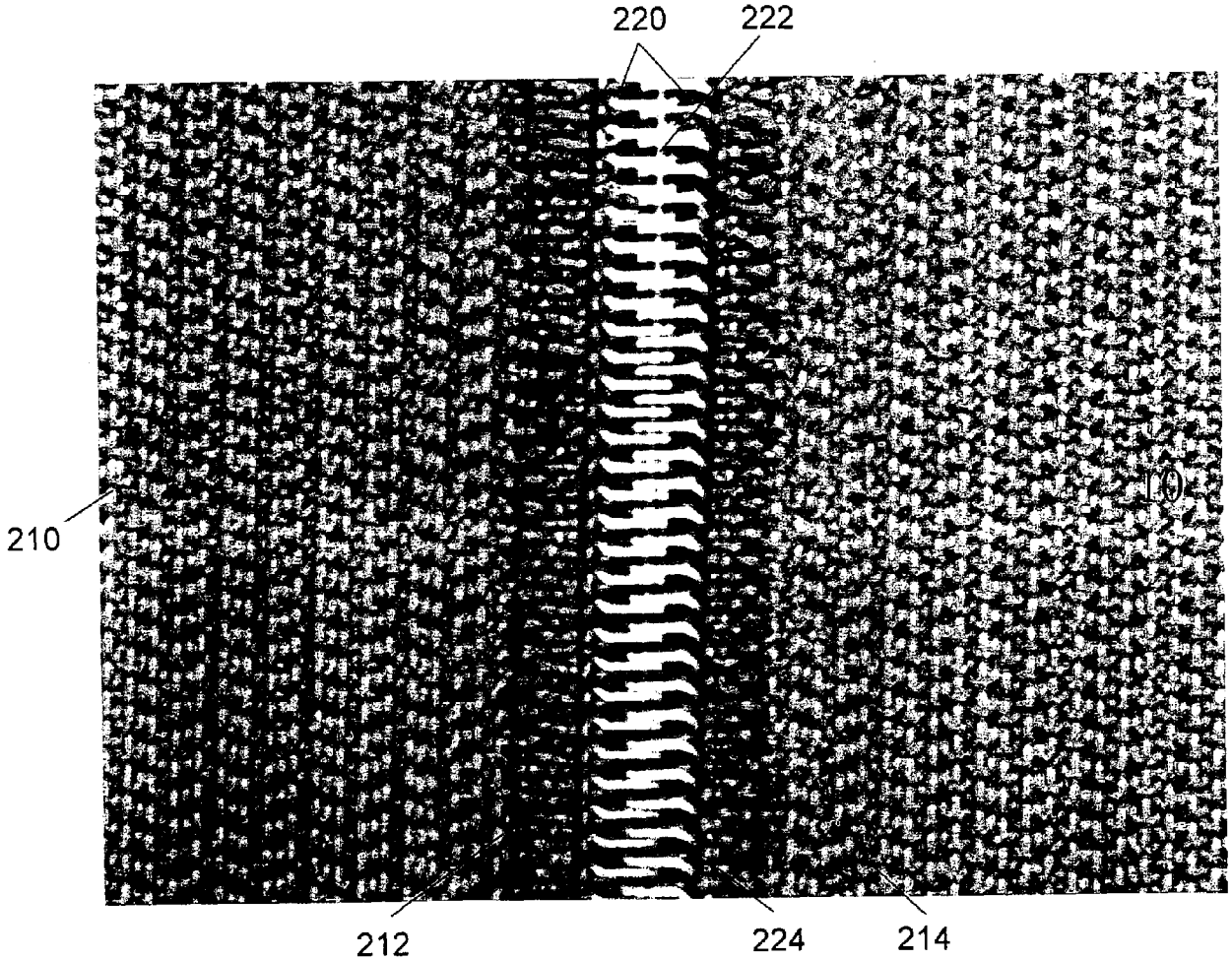
FIG. 4 is a top plan view of the seam, incorporating the teachings of the present invention.

As shown in FIG. 4, respective spirals 220 may be altenatively sewn onto the ends 212, 214 of the base fabric 210 with thread 224. The base fabric may be a woven fabric or a non-woven fabric. The spirals 220 can be made of any material suitable for the purpose (e.g. polyester, polyamide, polyethelyne, Ryton, PEEK, metal, etc.). The spirals do not need to be the same material. That is, the spiral secured to fabric end 212 may be made from a material that is different from the material making up the spiral secured to fabric end 214. In any event, after the spirals 220 are affixed, the ends 212, 214 are brought together and the spirals 220 intermeshed or interdigitated with each other so as to define a passage. A pin or pintle 222 is then inserted into the passage securing ends 212, 214 to each other.

The fabric ends 212 and 214 are preferably even, so that when they are joined together the fabric appears as an endless weave fabric without any discontinuities at the seam or along its widthwise edges. The MD yarns of the respective edges do not have to match perfectly, although such matching is preferred.

An alternative manner of affixing the spirals 220 to ends 212, 214 will now be discussed. Initially, it may be desirable to stabilize the fabric at ends 212, 214. Depending upon the composition of the fabric, it may be desirable to compact or squeeze some portion of ends 212, 214 for the full width of the fabric to reduce the overall thickness of the fabric so that some, preferably most, if not all the stitching lies within the plane of the main fabric body thickness. This may involve treating this end area by ultrasonic melting, pressing with or without heat, or chemically bonding the MD and CD yarns that make up the fabric ends 212, 214. Once this is done, the spirals 220 are attached. In another embodiment, this preprocessing of the fabric ends may preferably be done after the spirals are attached. In either case this involves sewing or stitching the respective spirals 220 to each end 212, 214. A yarn or thread 224 is used which may be made of any material suitable for the purpose (e.g. industrial polyester, nylon, Nomex, Kevlar (aramids), Spectran (HMPE), Vectran (LCP) and TENARA and other polymers). The size of the thread 224 will depend upon the application and strength requirements. For example, #69 industrial polyester thread has superior strength to that of #45 (such as those manufactured by American and Efird, Inc and Saunders Thread Co. in what is commonly referred to as the TEX system of designation, the higher number indicates a larger diameter). Higher diameter thread may also be desirable. The yarns or thread used should be of a diameter of less than or equal to the diameter of the machine direction (MD) or cross-machine direction (CD) yarns at the ends 212, 214. This diameter can be of the yarn as new, as used, or after a compaction or pressing step as heretofore mentioned.

The pattern of the stitching used may take on various forms such as zig-zag, chain, or lock stitch patterns. The depth of the stitch in the fabric may also vary. Also, it may be desired to have a preliminary stitch to generally affix or align the spiral 220 on ends 212, 214 and once aligned, implement a main stitching.

Also, once the stitching is completed, one or more rows of additional stitching parallel to ends 212, 214 or in the cross-machine direction (CD) and across the attachment stitching attaching the spiral, might be used to reinforce the spiral attachment. As much stitching that is required should be within the plane of the fabric thickness. There are multiple variations of what may be done.

As aforesaid, once the stitching is completed, the ends 212, 214 may be treated to otherwise stabilize the ends 212, 214 and reinforce and smooth the stitching thereon.

Note, the size, dimension or material in the spirals does not have to be the same in top and bottom. The bottom can be load bearing and the top designed to even out the pressure distribution and/or permeability. Different material top/bottom may also be desired.

The spirals do not have to be combined with the same loop density as the fabric layer, or have the same density in the top and bottom. For a coarse bottom spiral, it would be useful to connect that with >1 loop of the fabric layer. The top spirals could optionally be chosen with the same, lower or higher density as the fabric loop ends. A match with the choice of warp and/or shute density and dimensions is desired.

Filler material can also be useful in the spiral. Depending on the chosen process, the filler can be inserted before needling or after.

In addition, the spirals do not have to be the same during the earlier processing steps as that used later in the final installation of the fabric.

While spirals of different lengths in the machine direction have been disclosed, rather than employing a spiral, individual rings may be fixed to the ends of each layer of each of the plurality of the double-layer weaves thereby providing a similar benefit to the use of the spiral, but wherein each ring is independently constructed and fixed to the fabric to the MD yarns forming loops. Such an arrangement is set forth in co-pending U.S. patent application Ser. No. 10/202,101, entitled "On Machine Seamed Press Fabric With Rings Utilized in the Seam Area for Improved Flex Resistance and Secondary Seam Reinforcement", the disclosure of which is incorporated herein by reference. The rings are of different lengths in the MD so as to create a similar situation to that of the spirals of different lengths.

In addition, flow resistant material additions may be added to the double seam, in a manner set forth in U.S. Pat. No. 6,194,331 B1 issued Feb. 27, 2001, the disclosure of which is incorporated herein by reference. Briefly this reference involves an on-machine-seamable papermaker's fabric which includes a first and second base fabric, each of which is joined into endless form with a seam. The first and second base fabrics are attached to one another by at least one layer of staple fiber batt entangled therethrough such that they are offset with respect to one another in a lengthwise direction when so joined. The seaming loops at one width-wise edge of the first base fabric coincide with a non-seam region of the second base fabric, and seaming loops at one widthwise edge of the second base fabric coincide with a non-seam region of the first base fabric. These coincident non-seam regions have additional flow-resistant material included so that when the fabric is joined into endless form by closing both seams, it may, in the vicinities of the seams, have permeablilities to air and water substantially identical to the remainder of the fabric body thereof. Alternatively, the fabric includes a multi-layered integrally woven base fabric having two systems of machine-direction yarns forming seaming loops in two distinct rows separated from one another in a thicknesswise direction of the fabric along each of its two widthwise edges. The two distinct rows are offset with respect to one another in a lengthwise direction of the base fabric. The seaming loops in one row coincide with a non-seam region of the base fabric at each widthwise edge thereof. Again the coincident non-seam regions, as above, have additional flow-resistant material. Especially for use as a press fabric, batt fiber is applied to one or both sides of the base by commonly known techniques such as needling.

Although a preferred embodiment has been disclosed and described in detail herein, its scope should not be limited thereby; rather its scope should be determined by that of the appended claims.

What is claimed is:

1. A papermaking or other industrial fabric formed from a plurality of layers of a base fabric and having a seam where a first end of each of said layers of base fabric is attached to a corresponding second end of each of said layers of said base fabric, wherein at least one preformed attachment mechanism is attached to each of said ends of each of said plurality of layers of said base fabric, wherein a length of one of said preformed attachment mechanisms attached to said first end of a first of said plurality of layers in a machine direction is different from a length of another of said preformed attachment mechanisms attached to said first end of a second of said plurality of layers corresponding to said first end of said first of said plurality of layers and wherein the length of one of said preformed attachment mechanisms attached to said first end of said first of said plurality of layers in the machine direction is different from a length of another of said preformed attachment mechanisms attached to said second end of said first of said plurality of layers.

2. The papermaking or other industrial fabric as set forth in claim 1, wherein said preformed attachment mechanism comprises a spiral.

3. The papermaking or other industrial fabric as set forth in claim 1, wherein said preformed attachment mechanism comprises a plurality of attachment rings.

4. The papermaking or other industrial fabric as set forth in claim 1, wherein two preformed attachment mechanisms are used to attach said first and second ends of each of said plurality of layers of said base fabric.

5. The papermaking or other industrial fabric as set forth in claim 4, further comprising a pin positioned within both of said preformed attachment mechanisms attached to corresponding ends of each of said plurality of layers of said base fabric to attach said first and second ends of each of said plurality of layers of said base fabric.

6. The papermaking or other industrial fabric as set forth in claim 5, wherein said pins corresponding to at least two adjacent layers of said base fabric are offset from each other.

7. The papermaking or other industrial fabric as set forth in claim 1, wherein a total length in said machine direction of said preformed attachment mechanisms attached to each of said ends of a first of said plurality of layers of said base fabric is substantially equal to a total length in said machine direction of said preformed attachment mechanism attached to each of said ends of another of said plurality of layers of said base fabric adjacent said first of said plurality of layers of said base fabric.

8. The papermaking or other industrial fabric as set forth in claim 1, wherein batt fiber is applied to one or both sides of the base fabric.

9. The papermaking or other industrial fabric as set forth in claim 1, wherein at least one of said two adjacent layers of said base fabric are spiral formed.

10. The papermaking or other industrial fabric as set forth in claim 1, wherein said fabric includes additional flow resistant material in an area of the seam.

11. A method for forming a papermaking or other industrial fabric formed from a plurality of layers of a base fabric and having a seam wherein a first end of each of said layers of base fabric is attached to a corresponding second end of each of said layers of said base fabric, comprising the steps of:

attaching at least one preformed attachment mechanism to each of said ends of each of said plurality of layers of said base fabric; and positioning a pin positioned within both of said preformed spirals attached to corresponding ends of each of said plurality of layers of said base fabric to attach said first and second ends of each of said plurality of layers of said base fabric;

wherein a length of one of said preformed attachment mechanisms attached to said first end of a first of said plurality of layers in a machine direction being different from a length of another of said preformed attachment mechanisms attached to said first end of a second of said plurality of layers corresponding to said first end of said first of said plurality of layers; and wherein the length of one of said preformed attachment mechanisms attached to said first end of said first of said plurality of layers in the machine direction being different from a length of another of said preformed attachment mechanisms attached to said second end of said first of said plurality of layers.

12. The method as set forth in claim 11, wherein said preformed attachment mechanism comprises a spiral.

13. The method as set forth in claim 11, wherein said preformed attachment mechanism comprises a plurality of attachment rings.

14. The method as set forth in claim 11, wherein two preformed attachment mechanisms are used to attach said first and second ends of each of said plurality of layers of said base fabric.

15. The method as set forth in claim 11, wherein said pins corresponding to at least two adjacent layers of said base fabric are offset from each other.

16. The method as set forth in claim 11, wherein a total length in said machine direction of said preformed attachment mechanisms attached to each of said ends of a first of said plurality of layers of said base fabric is substantially equal to a total length in said machine direction of said preformed attachment mechanism attached to each of said ends of another of said plurality of layers of said base fabric adjacent said first of said plurality of layers of said base fabric.

17. The method as set forth in claim 11, further comprising at least one thread stitched in a zig-zag pattern to help secure said preformed spiral to at least one of said first end or said second end.

18. The method as set forth in claim 11, further comprising at least one thread stitched in a modified zig-zag pattern to help secure said preformed spiral to at least one of said first end or said second end.

19. The method as set forth in claim 11, further comprising at least one yarn stitched in a modified zig-zag pattern to help secure said preformed spiral to at least one of said first end or said second end.

20. A papermaking or other industrial fabric, comprising:

a plurality of layers of a base fabric having a seam where a first end of each of said layers of said base fabric is attached to a corresponding second end of each of said layers of said base fabric;

a preformed attachment mechanism attached to each of said ends of each of said plurality of layers of said base fabric; and a pin positioned within both of said preformed spirals attached to corresponding ends of each of said plurality of layers of said base fabric to attach said first and second ends of each of said plurality of layers of said base fabric;

wherein a length of one of said preformed attachment mechanisms attached to said first end of a first of said plurality of layers in a machine direction is different from a length of another of said preformed attachment mechanisms attached to said first end of a second of said plurality of layers corresponding to said first end of said first of said plurality of layers; and wherein the length of one of said preformed attachment mechanisms attached to said first end of said first of said plurality of layers in the machine direction is different from a length of another of said preformed attachment mechanisms attached to said second end of said first of said plurality of layers.

21. The papermaking or other industrial fabric as set forth in claim 20, wherein said preformed attachment mechanism comprises a spiral.

22. The papermaking or other industrial fabric as set forth in claim 20, wherein said preformed attachment mechanism comprises a plurality of attachment rings.

23. The papermaking or other industrial fabric as set forth in claim 20, wherein said pins corresponding to at least two adjacent layers of said base fabric are offset from each other.

24. The papermaking or other industrial fabric as set forth in claim 20, wherein at least one of said two adjacent layers of said base fabric are spiral formed.

25. The papermaking or other industrial fabric as set forth in claim 20, wherein said fabric includes additional flow resistant material in an area of the seam.

26. The papermaking or other industrial fabric as set forth in claim 20, wherein batt fiber is applied to one or both sides of the base fabric.

* * * * *